US006993432B2

(12) United States Patent
Jenkins et al.

(10) Patent No.: US 6,993,432 B2
(45) Date of Patent: Jan. 31, 2006

(54) SYSTEM AND METHOD FOR WELLBORE COMMUNICATION

(75) Inventors: Charles Roderick Jenkins, Willingham (GB); Ashley Bernard Johnson, Milton (GB); Harry Barrow, Girton (GB); Michael Paul Barrett, Histon (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 79 days.

(21) Appl. No.: 10/734,394

(22) Filed: Dec. 12, 2003

(65) Prior Publication Data

US 2004/0204856 A1 Oct. 14, 2004

(30) Foreign Application Priority Data

Dec. 14, 2002 (GB) ..... 0229328

(51) Int. Cl.
*G01V 11/00* (2006.01)

(52) U.S. Cl. ..... 702/13

(58) Field of Classification Search ..... 702/5, 702/6, 9, 12, 13, 14; 166/250.11, 250.1, 166/250.01; 73/152.55, 152.28, 152.02; 175/44, 45, 46, 48, 50

See application file for complete search history.

(56) References Cited

U.S. PATENT DOCUMENTS 5,991,602 A * 11/1999 Sturm ..... 455/40
6,117,643 A * 9/2000 Simpson et al. ..... 435/7.1
6,285,955 B1 * 9/2001 Goldwasser ..... 702/6
6,443,228 B1 9/2002 Aronstam et al.
2003/0205376 A1 * 11/2003 Ayoub et al. ..... 166/254.2

FOREIGN PATENT DOCUMENTS

| | | |
|---|---|---|
| GB | 1 549 307 | 7/1979 |
| GB | 2 352 041 A | 1/2001 |
| GB | 2 352 042 B | 4/2002 |
| WO | 99/66172 A1 | 12/1999 |
| WO | 00/73625 A1 | 12/2000 |

* cited by examiner

*Primary Examiner*—Donald McElheny, Jr.
(74) *Attorney, Agent, or Firm*—Jody Lynn DeStefanis; William B. Batzer; Dale Gaudier

(57) ABSTRACT

A method and system is disclosed for communicating information from a downhole location to the surface including a plurality of releasable vessels containing predetermined signal information affixed to the vessels prior to placement of the vessels downhole and indicative of the presence of at least one of three or more predetermined downhole conditions and a sensing and releasing system that senses the occurrence of the downhole condition, such as a simple threshold, and release the vessels in response to the sensing. The predetermined downhole condition can be characteristic of the fluid being produced in the borehole, such as water fraction, a certain level of mechanical wear or damage to downhole equipment such as bit wear, or the firing a one or more charges on a wireline deployed perforation tool.

46 Claims, 8 Drawing Sheets

SYSTEM AND METHOD FOR WELLBORE COMMUNICATION

FIELD OF THE INVENTION

The present invention relates to the field of telemetry in oilfield applications. In particular, the invention relates to an improved system and method for communicating from downhole devices to the surface without the use of cables.

BACKGROUND OF THE INVENTION

In many areas of oil exploration and development, communication between the surface and downhole is vital but difficult. This is true from drilling through to production and intervention in existing wells. The typical problem is effecting a channel of communication, by some method, down a long conduit filled with fluid. In most situations, the conduit (for example, the borehole) is considered the only practical physical route for information, as electromagnetic or elastic waves are strongly attenuated by passage through thick layers of rock. Conventional methods include pressure waves in the fluid (e.g. mud pulse telemetry) or the use of electrical cables, extending the length of the borehole. These conventional methods have disadvantages, which include cost, reliability, and low data rate.

Some ideas have been proposed around the idea of sending some object or element up or down the borehole. A raw piece of semiconductor memory onto which data is written by a downhole device has been disclosed. For example see, GB patent application Ser. No. 1 549 307. A more sophisticated and robust vessel containing memory has been disclosed by GB patent No. 2 352 041, and co-pending U.S. patent application Ser. No. 10/049,749 assigned to Schlurnberger Technology Corporation published as PCT application WO 01/04661. Alternatively, even more complex vessels containing a variety of sensors and data storage have been disclosed. For example, see GB Patent No. 2 352 042, and PCT Published Applications WO 99/66172 and WO 01/04660.

U.S. Pat. No. 6,443,228 discloses the use of flowable devices in wellbores to provide communication between surface and downhole instruments, among downhole devices, establish a communication network in the wellbore, act as sensor, and act as power transfer devices. In some embodiments, the upwards communication is proposed by writing information on the flowable devices downhole which are bound for the surface.

Co-owned U.S. Pat. No. 6,915,848 (incorporated herein by reference) discloses a well control system enabling the control of various downhole well control functions by instructions from the surface without necessitating the well or downhole tool conveyance mechanism being equipped with electrical power and control cables extending from the surface and without the use of complex and inherently unreliable mechanical shifting or push/pull techniques requiring downhole movement controlled remotely from the surface. The invention of this co-pending application makes use of downhole well control apparatus that is response to instructions from elements such as fluids or physical objects such as darts and balls that are embedded with tags for identification and for transmission of data or instructions. According to at least one disclosed embodiment, a downhole device may also write information to the element for return to the surface.

In these disclosed embodiments, where information is being sent from a downhole location to the surface, information is written to the device (or acquired by the device itself) downhole.

SUMMARY OF THE INVENTION

Thus, it is an object of the present invention to provide a system and method for upwards communication in a wellbore which is simple, robust, does not rely on cables extending from the downhole location to the surface, and does not require that the information being communicated be written downhole onto the elements or vessels being used for the communication. Thus the present invention addresses many of the difficulties associated with data transfer to separable elements in the downhole environment.

According to the invention a system is provided for communicating information from a downhole location in a hydrocarbon borehole to the surface. A plurality of releasable vessels are positioned at the downhole location, the vessels containing signal information affixed to the vessels prior to placement of the vessels downhole, and the signal information indicating the presence of at least one of three or more predetermined downhole conditions. A detecting system is positioned on the surface such that the signal information can be detected on one or more of the vessels. A processing system is located on the surface and is programmed to establish the presence of the predetermined downhole condition based on the signal information.

A sensing and releasing system is preferably provided to sense the occurrence of the downhole condition, preferably a simple threshold, and release the vessels in response to the sensing. The vessels are preferably located at a number of downhole locations, and preferably are convected to the surface by the flow of wellbore fluids. The vessels preferably comprise one or more radio frequency devices that acquire substantially all energy needed for operation by exposure to externally created electromagnetic field, an example of such a devices is an RF tag. The detection on the surface can be either "fly-by" or using a sieve in the flow line or in part of the oil-water separation system.

The predetermined downhole condition is preferably a characteristic of the fluid being produced in the borehole, such as water fraction. However according to alternative embodiments, the predetermined condition can also be a certain level of mechanical wear or damage to downhole equipment such as bit wear, or the firing of one or more charges on a wireline deployed perforation tool.

The present invention is also embodied in a method for communicating information to the surface from a downhole location in a hydrocarbon borehole.

As used herein the terms "vessel" and "element" to refer to a distinct physical entities that can be used in some way for conveying a signal. According to some embodiments, the vessel or element itself is the signal.

DETAILED DESCRIPTION OF THE INVENTION

The inventors have recognized that prior known methods for upward communication using elements are prone to the following types of practical problems to different degrees.

(1) Size, mass and transport. If objects are to move upward, against gravity, in a fluid-filled borehole they must either by buoyant, or experience enough fluid drag to move their mass. Buoyancy is not a solution in horizontal sections of wellbores. On the other hand, they need to be small enough to avoid blocking the borehole. Preferably they also need to be small enough to be used in large numbers, to give a reasonable chance of recovery. There are severe difficulties for complex, and therefore massive, objects. Not everything can be miniaturized by appealing to Moore's Law. (See FIG. 1, described more fully below). Downward motion under gravity is easier, but fails in horizontal sections of the borehole.

(2) Power. Complex objects need stored energy (perhaps as batteries or capacitors) to perform complex functions such as sensing and radio communication. Power storage costs mass, bulk, longevity and reliability, especially in the downhole conditions encountered in the oilfield.

(3) Data transfer. The objects that have no sensors have to acquire their data from somewhere else, and many known techniques rely on physical connections via conductive media such as metal wires. Such connections are prone to problems of reliability in downhole conditions, and are vulnerable feed-throughs in the casing or encapsulation of the object that carries the data storage.

(4) Detection and recovery. Whether in drilling, production or intervention there is a practical issue in locating the object and extracting the data from it. For example, in production there may be very high fluid flow rates at the surface, passing through vital chokes; any objects have to either pass through the chokes and be detected afterwards, or else detected before the chokes and prevented from blocking or damaging them.

(5) Disposal. In general it is very undesirable to leave solid objects behind in oil wells at any stage of their development, and even chemicals (especially radioactive ones) may pose problems. This has implications both for recovery, and also for control of buoyancy; jettisoning heavy parts may result in jamming or fouling elsewhere in the well.

Figure 1:
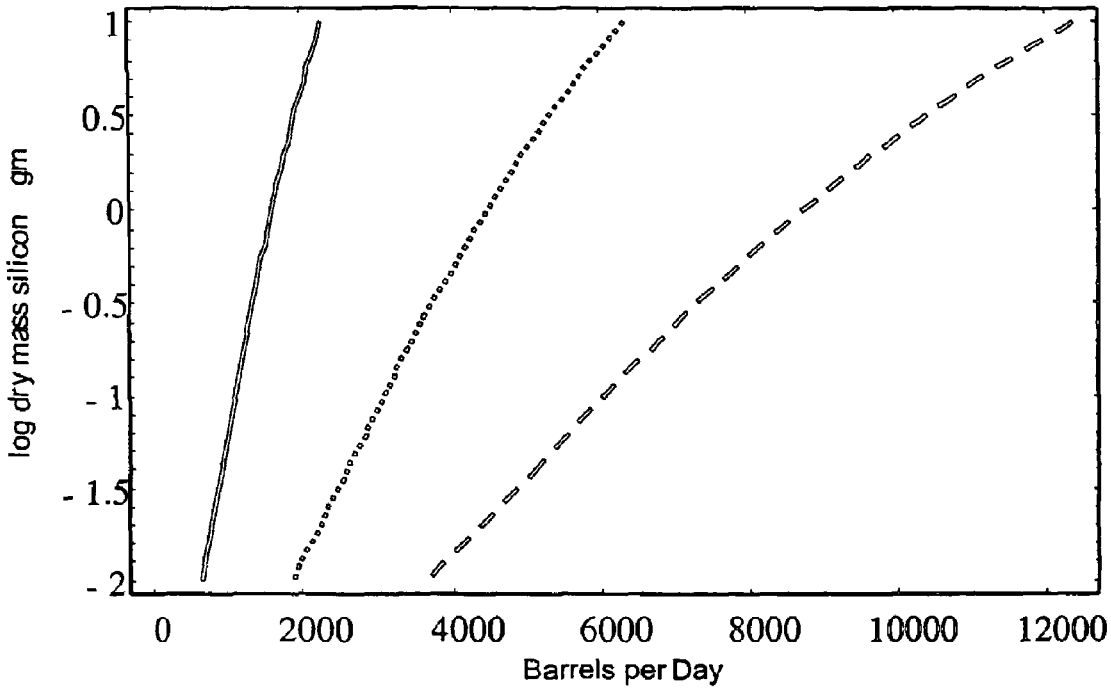
FIG. 1 shows the mass of a silicon sphere, which would be moved upward by fluid flow, plotted against the productivity of a well.

FIG. 1 shows the mass of a silicon sphere, which would be moved upward by fluid flow, plotted against the productivity of a well. Silicon is used here as an approximation to represent relatively closely packed electronic components. The fluid produced is assumed to be largely water. The fluid velocities are calculated for various casing sizes. The solid line represents a 3 inch casing. The dotted line represents a 5 inch casing. The dashed line represents a 7 inch casing, which is fairly typical. The smaller sizes correspond to typical production tubing diameters. The object has to move in the slowest section of the well and it can be seen that only very light objects will do this.

Figure 2:
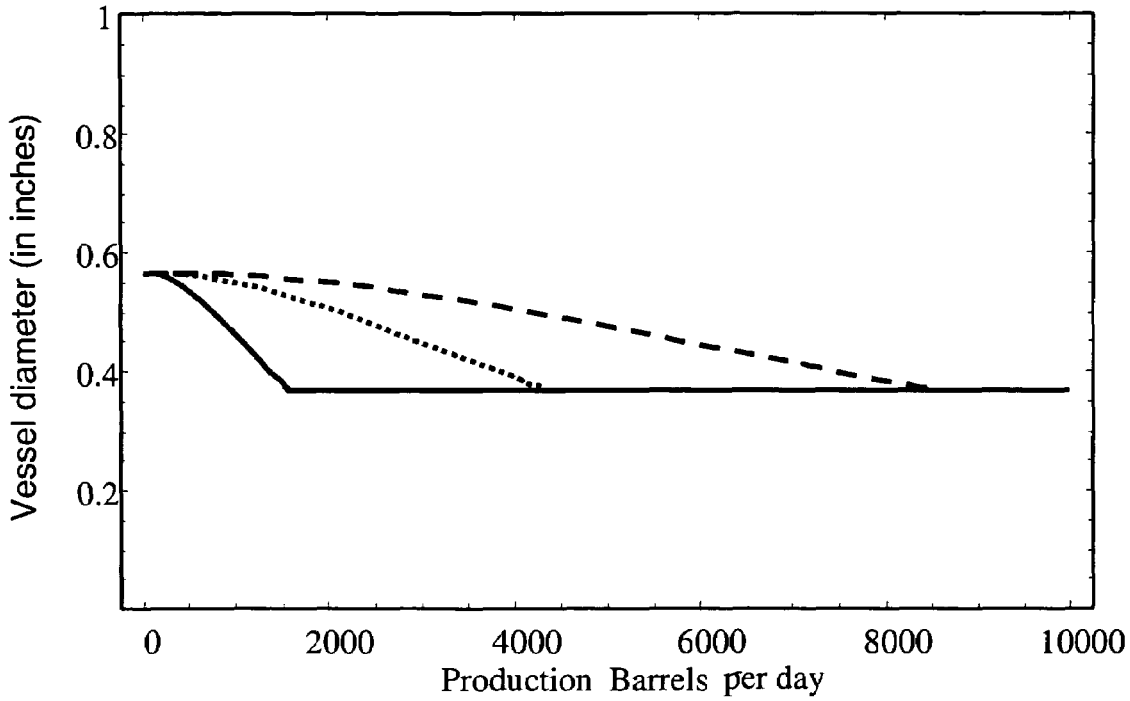
FIG. 2 shows the size necessary for 1 gram of silicon to be convected in the flow, computed as in FIG. 1.

FIG. 2 shows the size necessary for 1 gram of silicon to be convected in the flow, computed as in FIG. 1. The solid line represents a 3 inch casing. The dotted line represents a 5 inch casing. The dashed line represents a 7 inch casing. In FIG. 2, the silicon has been encapsulated in a low-density epoxy (0.5 gm/cc). It can be seen from FIG. 2 that much more useful sizes are feasible, and in fact 1 gm will be an adequate mass for a simple read-only radio frequency tag. The lines become horizontal when no encapsulation is necessary for the object to move.

In a producing oilwell, small amounts of data can be very useful, most especially if they are referred to accurately-known positions in the well. Sophisticated production logging tools can measure many parameters of a flowing well, but a log is expensive, disruptive, and is sometimes hazardous to perform. In many cases the properties of a reservoir, penetrated by a well, will be fairly accurately known. Remedial actions, to improve productivity, can then be taken on the basis of relatively simple data. For example "threshold" data can be very valuable, such as information that the water fraction or pressure has exceeded a critical value at a certain position. Conveying information about several thresholds would be even more valuable. The generic data to be conveyed is then simply the pair (X, Y), where X encodes position and Y encodes a threshold. X and Y need not be numbers—for example, X could be encoded by one radioactive tracer in the flow, and Y by another. The key concept is that data transmission is achieved by placing, in advance, vessels or elements to convey pre-determined signals (X, Y) at well-defined positions in the well. Preferably associated with these placements of vessels or elements are fixed sensors, power supplies, and means of release. When the condition associated with Y is measured at position X, the signal (X, Y) is released. Upon detection and recovery of the vessel at surface, the attached signal can be decoded by reference to the "code book" describing how the signaling system was originally set up.

According to the invention, this relatively simple scheme allows the use of extremely simple signaling methods, and advantageously does not rely on data transfer downhole into whatever vessel or element we choose to carry, or to be, the signal. This advantageously eliminates a technically difficult and unreliable step.

Figure 3:
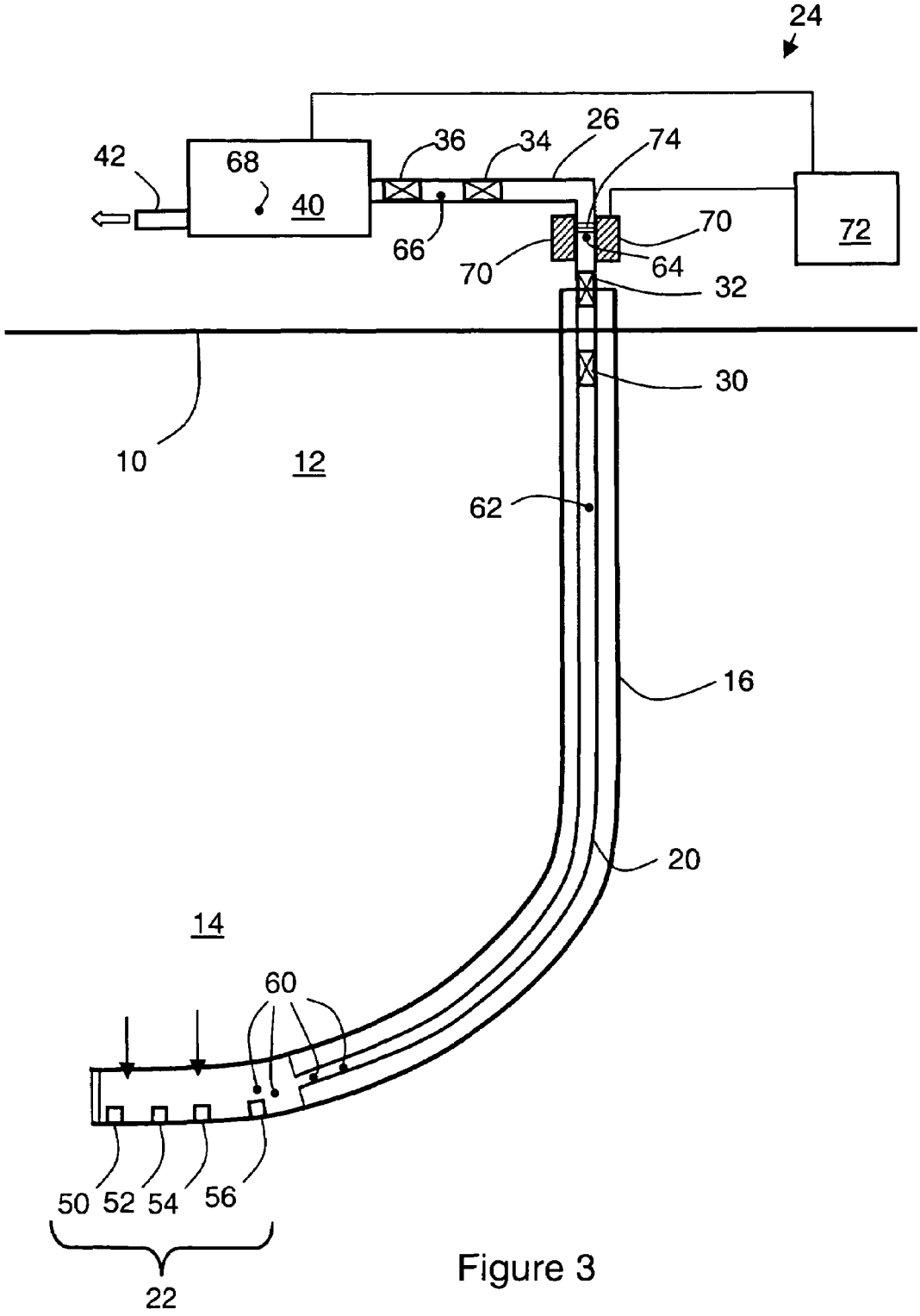
FIG. 3 shows a system for communicating information from downhole to the surface, according to preferred embodiments of the invention.

FIG. 3 shows a system for communicating information from downhole to the surface, according to preferred embodiments of the invention. The system generally comprises downhole sensors and associated release mechanisms 22, vessels 60, and surface detection system 24. There are four sensor/release mechanisms 22, numbered 50, 52, 54 and 56, positioned in the lower end of well 16. Well 16 is producing hydrocarbons from reservoir region 14 in the earth 12. The vessels 60 are constructed to have a high probability of surviving downhole pressures and temperatures, and will be carried to the surface reliably by the flowing liquids in the well 16. As is described more fully herein, the vessels 60 are released from the sensor/release mechanisms 22 in appropriate batches in accordance with a pre-determined program. Surface detection system 24 detects and/or recovers, and interpret the signals conveyed by vessels 60.

Figure 4:
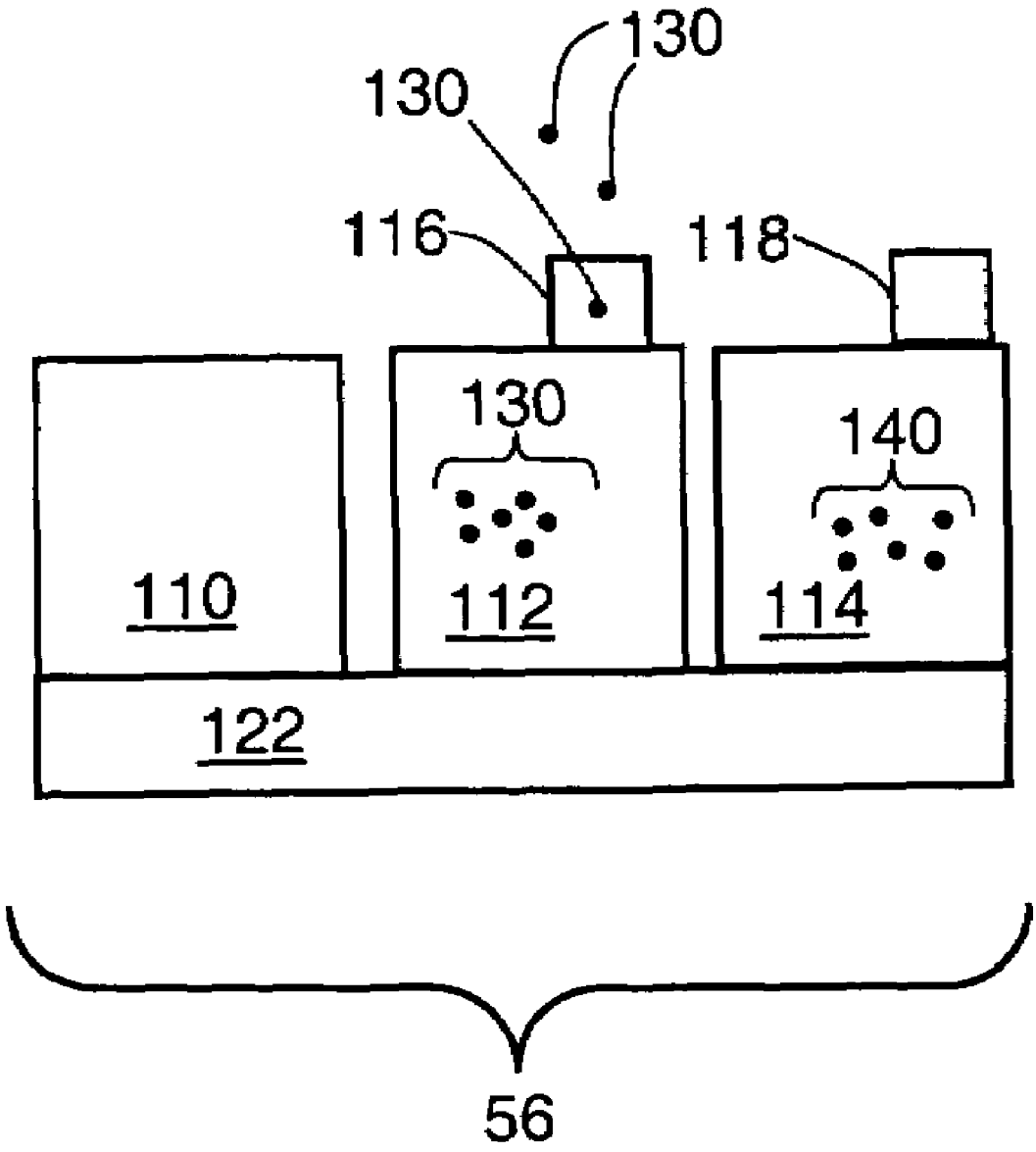
FIG. 4 shows further detail of one of the sensor/release mechanisms, according to a preferred embodiment of the invention.

FIG. 4 shows further detail of one of the sensor/release mechanisms, according to a preferred embodiment of the invention. Downhole sensor 110 is adapted to sense a downhole condition, for example pressure, temperature, fluid composition (such as water), and/or flow rates. Sensors of these types are well-understood technology, as are the high-temperature batteries that are preferably used to power the sensors. Alternatively, other sources of power can be provided, such as small turbines or oscillating magnetic floats forming a primitive generator. Sensor 110 is in communication with processor 56 which may comprise a number of microprocessors. Nests 112 and 114 contain vessels 130 and vessels 140 respectively. Associated with nests 112 and 114 are release mechanisms 116 and 118. Under control of processor 122, release mechanisms 116 and 118 can be fired. The firing mechanism may be an actual detonation of a small explosive charge, exposing the vessels to the flow; or it may operate by undoing a small latch, which restrains a spring-loaded hatch; or some combination of these methods. Release mechanisms 116 and 118 are instructed to release the vessels in accordance with a program in processor 122. According to a preferred embodiment, release mechanism 116 is instructed to release all of the vessels 130 in nest 112 when a predetermined threshold is met by sensor 110. For example this could be a certain temperature or pressure sensed by sensor 110. Likewise, release mechanism 114 is instructed to release all of its vessels 140 when a different predetermined threshold is met by sensor 110.

According to a preferred embodiment, the sensor/release mechanism 56 is positioned a known position in the well. This known position is encoded in all the vessels 130 and 140 contained in each of the nests 112 and 114 respectively. The encoding may be made by many different methods, but it should be made such that when detected on the surface, it can be determined from which location the vessel came from.

The signaling method for the vessels will now be described in further detail. The preferred vessels use radio frequency (RF) tags. RF tags are described in some detail U.S. patent application Ser. No. (25.200) (hereinafter "Thomeer"), for a communication task involved in downhole intervention. Thomeer discloses circulating read-write tags up and down the borehole, but for the signaling task of the present invention the much simpler read-only (RO) tags are preferably used. Furthermore, the RO-RF tags are preferrably designed such that they are only intended to be used once.

The preferred RO-RF tags are tiny electronic circuits that, for proposes of the present invention, have the following characteristics:

(1) They are transponders that emit a unique signal (typically electromagnetic, at radio frequencies) when interrogated by another electromagnetic signal;

(2) They acquire all necessary power from the interrogating electromagnetic field—preferably, no conductive connection is ever required; and (3) They are small, light and relatively inexpensive.

An example of suitable RO-RF tags are those used as retail anti-theft tags, which is simply a loop antenna tuned to a definite frequency. The interrogating field sees a strong reflection from the antenna, whose presence is simply the signal one is looking for. According to another embodiment, more elaborate tags contain serial numbers, imprinted in the tags at manufacture. Such serial numbers would be good candidates for matching up with the (X, Y) pairs described above. In that notation, every tag deployed at the same position would have the same X-value. The Y-element of the tag would not be needed, if tags were intended for release at just one threshold. Of course there could be different thresholds at different locations, or a set of thresholds, as in the example described above with respect to FIG. 4.

According to another embodiment, the RF tag uses a range of resonant frequencies to form the elements of a coding alphabet.

The preferred signaling system uses RO-RF tags encapsulated in low-density epoxy. By choice of materials, one can obtain a vessel that will be dragged along even at low fluid speeds (less than 0.1 m/s). It is preferable to ensure that the vessel is not too buoyant, as it may become trapped against obstacles-on the "roof" of horizontal sections of the wellbore. On the other hand it must be light enough to be lifted by the flow, and not so small that it becomes becalmed in beds of detritus, stagnant layers or eddies. Due to these considerations it has been found that a spherical shape approximately one centimeter in diameter is suitable, depending in the particular materials used. However is relatively low flow situations, as shown in FIG. 2, larger vessels are preferred. Thus in low flow applications a vessel size up to two centimeters is preferred. Other shapes that have also been found to be effective include hollow cones (like badminton shuttlecocks) or spheres with long tails, like kites. These more complex shapes offer a better drag/mass ratio, and additionally offer space to place longer antenna than can be fitted in the tags themselves. This increases the detectability of the tags. On the other hand, the simple sphere is less likely to become snagged or entangled.

According to another embodiment, the tags are contained in hollow spheres, and maintained at ordinary (atmospheric) pressures. This gives buoyancy in a natural way and reduces some manufacturing problems posed by encapsulation to resist downhole pressures. The vessels are preferably made strong enough to resist implosion and light enough to move in the flow. Additionally, they have to be made of non-conductive materials (or else RF communication through them becomes impossible). Ceramic materials, such as zirconia or alumina, may be used in this application but are more expensive and more difficult to machine.

According to the invention, further detail will now be provided regarding the programming of the release strategy for the vessels. The strategy is decided in advance, when the "nests" are deployed in the borehole. The simplest strategy, as noted, is to release a nest of vessels when some physical variable passes a predetermined value. The controlling processor preferably has a provision, in processing the sensor data that ensures the threshold has not been passed because of a one-off noise spike. In this case the only signal to be decoded, on recovery at surface, would correspond to the position in the well from which the vessel originated.

According to another embodiment, a more complex strategy is provided that includes a set of release thresholds that is different for each location. Additionally, releases can be programmed to happen when the variable being sensed changes more quickly than a predetermined rate.

Referring again to FIG. 3, the surface detection system 24 will now be described. The fluid being produced in well 16 reaches the surface 10 via production tubing 20. Near the surface 10 are two safety valves 30 and 32. On the surface, the produced fluid flows through flow line 26, through choke valves 34 and 36 and then into oil/water separation system 40. Choke valves 34 and 36 are the primary means for controlling the pressure in the well 16. After separation, the oil component is carried via pipe 42 to subsequent surface production and/or refining equipment.

Detection, interrogation and recovery of tags when they reach the surface will now be described. According to a preferred embodiment, the tags within vessels 60 are detected on the surface by tag detector 70 as they move along with a high-speed, high-pressure flow, just before they reach the chokes 34 and 36. In FIG. 3, vessel 62 is shown passing up production tube 20 and vessel 64 is shown passing by detector 70. The detector 70 transmits the detected information to surface processing system 72. Because the chokes are so vital to well control, it is preferred to recover the vessels before the chokes.

The tags within the vessels act as transponders of RF electromagnetic radiation which is directed into the flowline 26 by internal antenna contained in detector 70. Since flowline 26 is made of a conductive metal, it functions as a waveguide. The wavelengths used in commercially available RF tags are well above the cutoff wavelength of typical size of flowline 26, and so the interrogating radiation will not propagate more than about the pipe diameter. Therefore in order to detect the tags within the vessels as they "fly by" the detector 70, preferably a relatively large number of vessels are released together, and the antennae of detector 70 in the pipe are large and/or numerous enough to ensure an adequate volume of investigation.

According to an alternative preferred embodiment the vessels are stopped, by means of a series of sieves 74 which form part of detector 70. The sieves 74 preferably form part of the interrogating antenna. Once a vessel has been stopped, such as vessel 64, the tag residing in vessel 74 is detected and interrogated by detector 70. Following detection, the vessels are preferably be disabled as otherwise the accumulation of tags on the sieve will lead to difficulties in reading them uniquely. This is preferably achieved by delivering a pulse of RF power from detector 70, of sufficient intensity to destroy a component in the tag. This technology is commercially available and is used to disable some types of retail alarm tags once payment has been made for the item to which they are attached.

The antennae on tags are much smaller than a wavelength and so they have the reception pattern of a dipole. This means that they cannot respond to radiation coming from some directions. The interrogating antenna therefore should be designed to deal with this polarization effect, preferably by being arranged to produce all three directions of the electric or magnetic field that may couple to the antenna.

After some time in operation it becomes necessary to clean or renew sieves. At stage, bypass pipework, not shown, is preferably used to maintain flow from the well, while the sieving section is removed and maintained.

According to an alternative embodiment, the vessels are made small enough to pass easily though choke valves 34 and 36, and pass into the oil/water separation system 40. Vessels 66 and 68 are shown thus in FIG. 3. The vessels are detected in the somewhat more quiescent environment of the separating system 40 using a system with an interrogating antenna similar to that described above. Since fluids have a relatively long residence time in separation system 40, time is not a problem in detecting the tags. Due to the relatively large volume of investigation, and high attenuation of radio frequencies by salt water, it is preferred that quite powerful transmitters be used to search the whole volume of a separator.

Note that although the example of FIG. 3 shows a land production site, the invention is also applicable to offshore and transition zone wells. In the case of marine applications, where the flowlines from multiple wells are typically combined on the seabed, it is preferable to have the detecting systems mounted upstream from the confluence to more easily detect from which well the vessel originated. Even more preferably, the detecting system is mounted below the Christmas tree to avoid the vessels passing through the Christmas tree valves.

According to the invention, alternative embodiments to the use of read-only RF tags will now be described in further detail.

According to one embodiment, microdots are used as the vessels. Microdots are tiny plastic particles which have serial numbers written on them. They are small enough to be incorporated into paint, for example. Very large numbers could be released into the flow, as described for RF tags, and they are small enough to be certain to be carried up the borehole. They are also small enough to pass through the chokes with no risk. Recovery is more difficult than with RF tag vessels. Regular samples of fluids are preferably taken from the separation system 40 and examined under a microscope. An alternative is to encapsulate the microdot together with a simple dipole antenna, a loop for example; the combined device then becomes functionally similar to an RO RF tag, in that the microdot contains the signal information and the loop is used to detect the presence of the vessel. The dipole loop is preferably designed to reflect radio energy at a certain predetermined frequency through resonance.

Alternatively a dipole without the microdot can be used as the vessel. The dipole is preferably tuned to one of a range of frequencies. This gives a simple alphabet for signaling. Multiple dipole antennae tuned to reflect different predetermined frequencies can be combined into a single vessel, or could each be in separate vessels, but released in combination to produce the signal information.

Such simple dipole antenna have the advantage of relatively short response times compared with conventional RF tags and therefore are preferred in use on "fly-by" read embodiments where detection is accomplished without the use of sieves or screens.

According to another embodiment, a combination of signaling techniques are used. For example, radioactive tracers can be used to signal that microdots were about to arrive. This type of combination would have advantages when the "arrival" signal was cheap and easy to detect, and heralded the arrival of very informative entities, which were not so easy to locate without mobilizing special resources.

According to other embodiments, the signaling techniques describe above is used to convey information not relating to parameters of the fluids in a producing oil well. For example, signaling of mechanical damage or wear in an oil well is simply achieved by the techniques described above, by embedding vessels at points in machinery where they will naturally be released if there is excessive wear or damage at that point.

Figure 5:
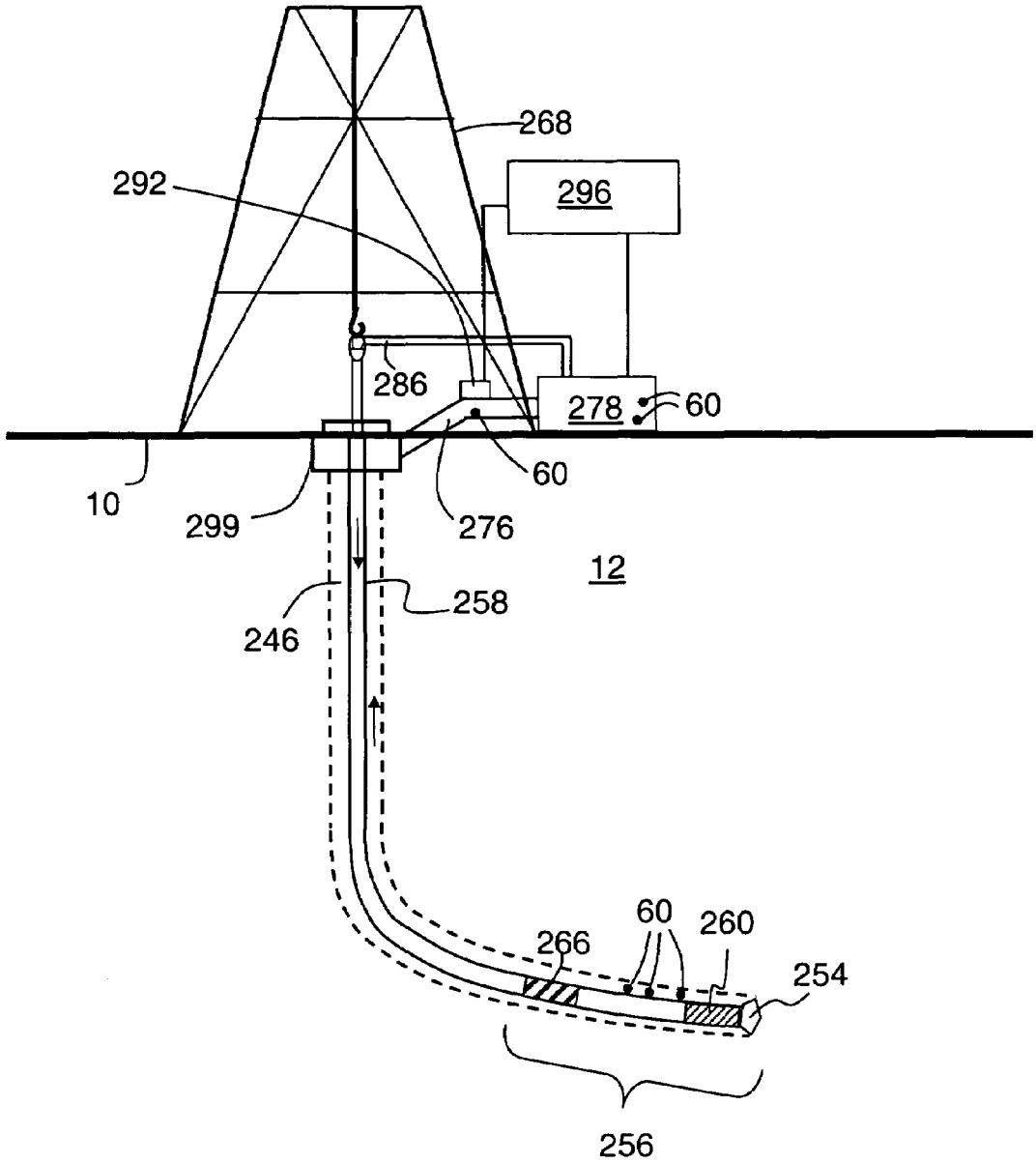
FIG. 5 shows a system for borehole telemetry during the drilling process, according to a preferred embodiment of the invention.

FIG. 5 shows a system for borehole telemetry during the drilling process, according to a preferred embodiment of the invention. Drill string 258 is shown within borehole 246. Borehole 246 is located in the earth 12 having a surface 10. Borehole 246 is being cut by the action of drill bit 254. Drill bit 254 is disposed at the far end of the bottom hole assembly 256 that is attached to and forms the lower portion of drill string 258. Bottom hole assembly 256 contains a number of devices including various subassemblies 260 including those used for measurement-while-drilling (MWD) and/or logging-while-drilling (LWD). Information from subassemblies 260 is communicated to a Pulser assembly 266 which converts the information into pressure pulses for transmission to the surface through the drilling mud as is known in the art.

The drilling surface system includes a derrick 268 and hoisting system, a rotating system, and a mud circulation system. Although the drilling system is shown in FIG. 5 as being on land, those of skill in the art will recognize that the present invention is equally applicable to marine environments.

The mud circulation system pumps drilling fluid down the central opening in the drill string. The drilling fluid is often called mud, and it is typically a mixture of water or diesel fuel, special clays, and other chemicals. The drilling mud is stored in mud pit which is part of the mud separation and storing system 278. The drilling mud is drawn in to mud pumps (not shown) which pump the mud though stand pipe 286 and into the Kelly and through the swivel.

The mud passes through drill string 258 and through drill bit 254. As the teeth of the drill bit grind and gouges the earth formation into cuttings the mud is ejected out of openings or nozzles in the bit with great speed and pressure. These jets of mud lift the cuttings off the bottom of the hole and away from the bit, and up towards the surface in the annular space between drill string 58 and the wall of borehole 246.

At the surface the mud and cuttings leave the well through a side outlet in blowout preventer 299 and through mud return line 276. Blowout preventer 99 comprises a pressure control device and a rotary seal. The mud return line 276 feeds the mud into the separation and storing system 278 which separates the mud from the cuttings. From the separator, the mud is returned to the mud pit for storage and re-use.

According to the invention vessels 60 are embedded behind the cutters of the drill bit 254, such that they are released when the cutters break. Vessels 60 are also nested in part of subassemblies 260 such that they are released when a predetermined event occurs. In this embodiment, microdots are the preferred type of vessel due their ruggedness and relatively small size.

Figure 7:
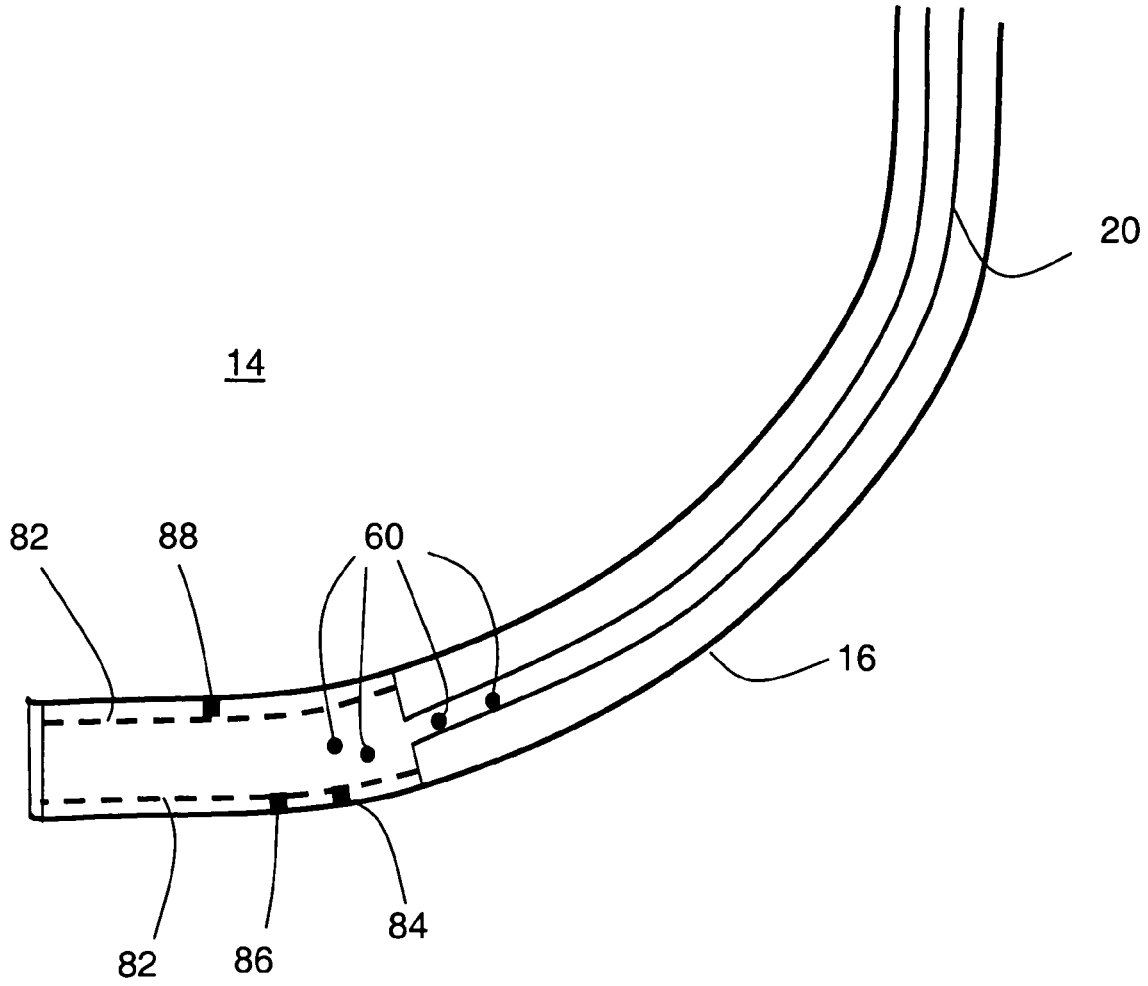
FIG. 7 shows a system for communication where the sensor/release mechanisms are placed behind wellbore liners, according to an embodiment of the invention.

FIG. 7 shows a system for communication where the sensor/release mechanisms are placed behind wellbore liners, according to an embodiment of the invention. According to this embodiment, sensor/release mechanisms 84, 86 and 88 are placed behind slotted expandable liner 82 in the producing zone of well 16 within reservoir region 14. The vessels 60, shown flowing into and through production tubing 20, are selectively released when erosion of the liners becomes severe. In this embodiment, microdots are preferred as vessels 60 due to their relative robustness and small size.

Figure 6:
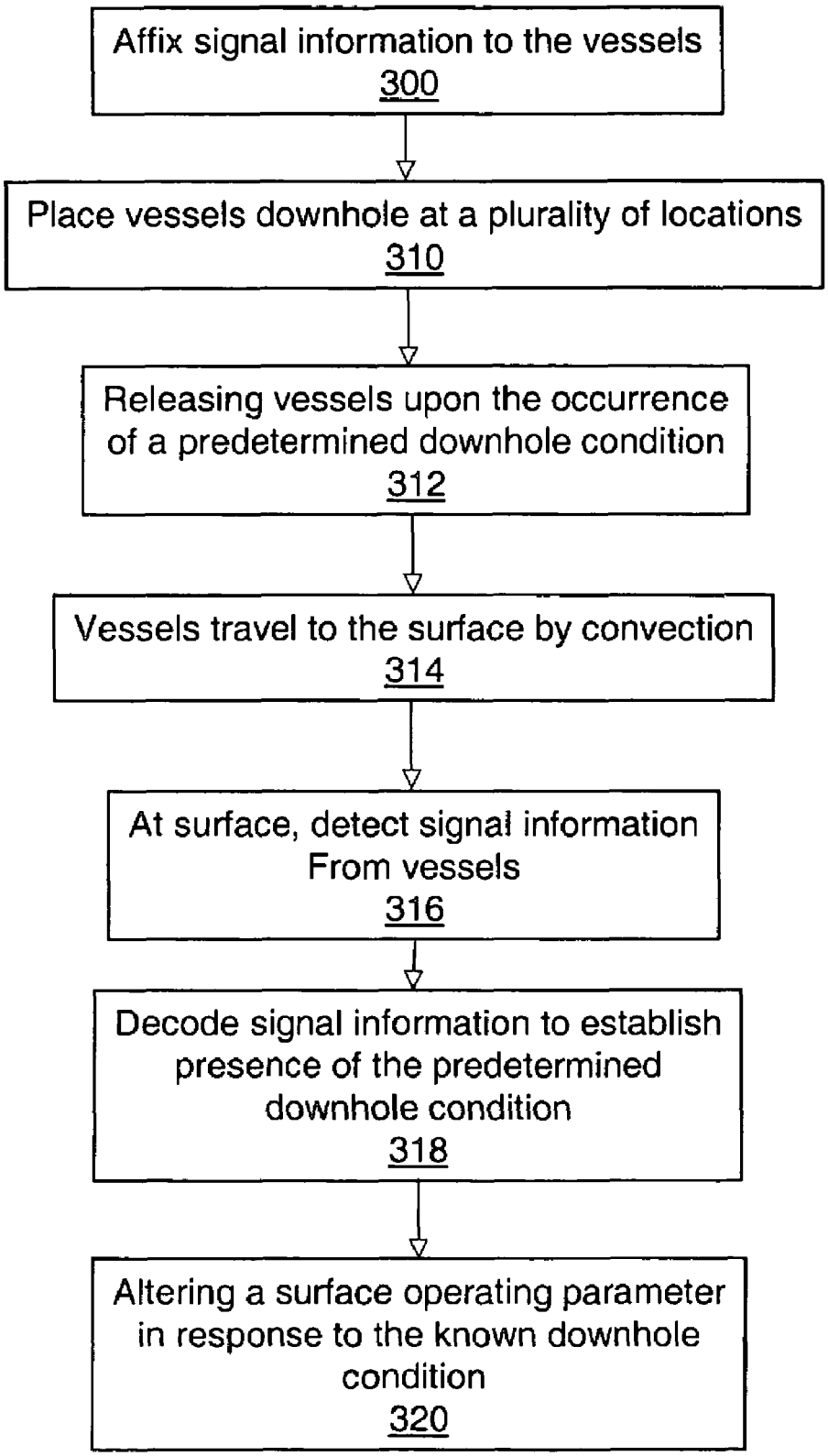
FIG. 6 shows steps in communicating information from a downhole location to the surface, according preferred embodiments of the present invention.

FIG. 6 shows steps in communicating information from a downhole location to the surface, according preferred embodiments of the present invention. In step 300 the predetermined signal information is affixed to the vessels. This is done at the surface using one or more of the techniques described above, (e.g. RF tags, dipole antennae, microdots, etc.). In step 310 the vessels having the signal information already written to them are placed downhole at a plurality of locations. The locations are preferably predetermined and correspond to the signal information as has been described above. In step 312 some of the vessels are released upon the occurrence of a predetermined event. In step 314 the vessels travel to the surface preferably by convection. In step 316, at the surface, the signal information is detected using the detection system(s) described herein. In step 318 the signal information is decoded, preferably in a processor such as a computer system programmed for the decoding. Based on the decoding, the processor establishes the presence of the downhole condition—such as a certain threshold measurement being reached by a sensor at a particular location in the wellbore. In step 320, one or more surface operating parameters are altered in response to the known downhole condition. For example, if the downhole condition is water fraction above a certain amount at a particular location, downhole valves are preferably used to control the production to maximize produced oil while minimizing produced water.

Figure 8:
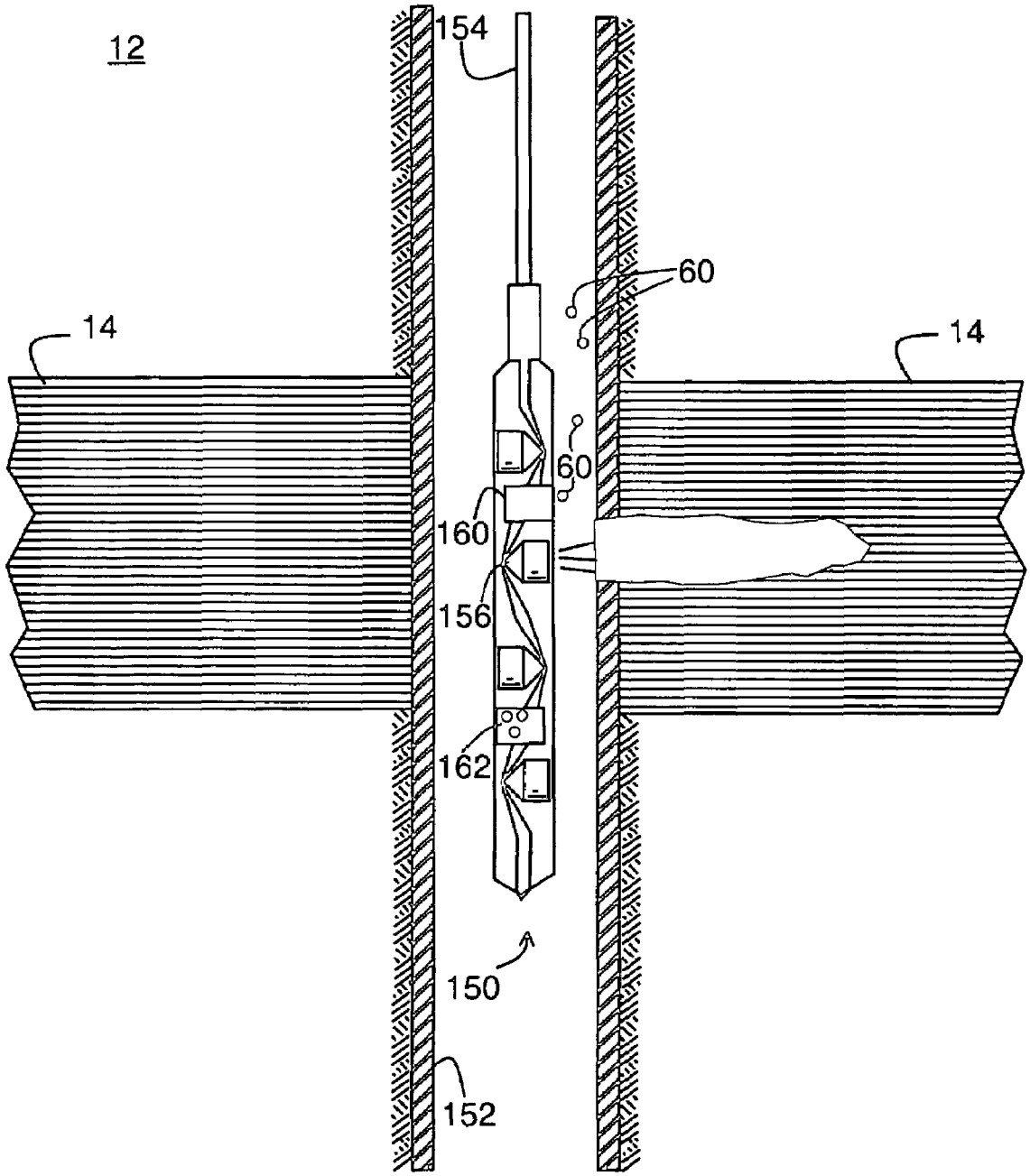
FIG. 8 shows a perforation tool incorporating releasable vessels, according to a preferred embodiment of the invention.

FIG. 8 shows a perforation tool incorporating releasable vessels, according to a preferred embodiment of the invention. Perforation gun 150 is suspended from wireline 154. The perforation gun 150 comprises essentially a plurality of shaped charges mounted on the gun frame. One of the charges 156 is shown in FIG. 8 firing. The firing charge produces a perforation through the casing 152 and into the reservoir region 14 in the earth 12. According to the invention, a sensor/release mechanisms 160 and 162 are provided to detect the firing of each shaped charge and release vessels to communicate to the surface that the charge was properly fired. In FIG. 8, sensor/release mechanism 160 is shown releasing vessels 60. According to an alternative embodiment, the vessels are incorporated into the charges themselves, such that they are automatically released when the charge is fired. In both of these embodiments, the preferred vessel is a microdot, due to its relative size and robustness.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A system for communicating information from a downhole location in a hydrocarbon borehole to the surface comprising:

a plurality of releasable vessels positioned at the downhole location, the vessels containing signal information affixed to the vessels prior to placement of the vessels downhole, and said signal information indicating the presence of at least one of three or more predetermined downhole conditions;

a detecting system on the surface positioned and adapted to detect the signal information on one or more of the vessels; and a processing system on the surface programmed to establish the presence of the predetermined downhole condition based on the signal information.

2. A system according to claim 1 further comprising a releasing system adapted to release the vessels at the occurrence of a predetermined event.

3. A system according to claim 2 further comprising a sensor in communication with the releasing system adapted to sense downhole conditions and wherein the releasing system releases the vessels when the predetermined event is indicated by the sensor.

4. A system according to claim 3 wherein the predetermined event is met when a value sensed by the sensor reaches a predetermined threshold value, and the predetermined downhole condition is the sensing of the predetermined threshold value at the location of the sensor.

5. A system according to claim 1 wherein a plurality of vessels are placed at a plurality of predetermined positions in the borehole.

6. A system according to claim 1 wherein the signal information is sufficient to determine at the surface (1) a value sensed by a sensor and (2) a location where the value was sensed.

7. A system according to claim 1 wherein the vessels are adapted to be convected to the surface by the flow of fluids in the borehole.

8. A system according to claim 1 wherein each of the vessels are sealed in a non conductive medium.

9. A system according to claim 1 wherein the vessels each comprise one or more radio frequency devices that acquire substantially all energy needed for operation by exposure to externally created electromagnetic field.

10. A system according to claim 9 wherein the radio frequency devices are RF tags.

11. A system according to claim 10 wherein the RF tags are read-only.

12. A system according to claim 9 wherein the radio frequency devices are simple dipole antennae.

13. A system according to claim 12 wherein each of the vessels comprises a plurality of dipole antennae each tuned to resonate at a different frequency, and the signal information being contained in the combination of frequencies.

14. A system according to claim 1 wherein the vessels are spherical in shape.

15. A system according to claim 14 wherein the vessels are at most 2 centimeters in diameter.

16. A system according to claim 10 wherein the vessels are hollow and an RF tag is positioned inside each vessel.

17. A system according to claim 16 wherein the vessels are filled with a fluid.

18. A system according to claim 10 wherein each vessel is primarily solid epoxy surrounding the RF tag.

19. A system according to claim 1 wherein the vessels is cone shaped.

20. A system according to claim 1 wherein the vessels are kite shaped.

21. A system according to claim 1 wherein the detection system is adapted to detect the presence of the vessels as the vessel fly by through a tube containing fluid produced form the borehole.

22. A system according to claim 21 wherein the detection system is adapted to detect the signal information as the vessel fly by through a tube containing fluid produced from the borehole.

23. A system according to claim 1 wherein the detection system comprises a sieve or filter.

24. A system according to claim 1 wherein the detection system is adapted to retrieve the vessels from a surface separations system for separating oil and water.

25. A system according to claim 1 wherein each vessel comprises at least one microdot.

26. A system according to claim 25 wherein each vessel further comprises at least one radio frequency device that acquire substantially all energy needed for operation by exposure to externally created electromagnetic field.

27. A system according to claim 26 wherein the radio frequency device indicates to the presence of the vessel to the detecting system and the microdot indicates the signal information to the detecting system.

28. A system according to claim 1 wherein the at least one predetermined downhole condition is a characteristic of fluid being produced from the borehole.

29. A system according to claim 1 wherein the at least one predetermined condition is predetermined fraction of water sensed at a particular location.

30. A system according to claim 1 wherein the at least one predetermined condition is a predetermined level of mechanical wear or damage to equipment located downhole.

31. A system according to claim 30 wherein the at least one predetermined condition is a predetermined level of mechanical wear or damage to a drill bit.

32. A system according to claim 30 wherein the at least one predetermined condition is a predetermined level of erosion of a slotted and/or expandable wellbore liner.

33. A system according to claim 1 wherein the releasable vessels are positioned on a wireline tool.

34. A system according to claim 1 wherein the releasable vessels are positioned on a perforation tool and the at least one predetermined downhole condition is the firing of at least one charge on the perforation tool.

35. A method for communicating information to the surface from a downhole location in a hydrocarbon borehole comprising the steps of:

positioning a plurality of releasable vessels at the location downhole, the releasable vessels including signal information affixed to the vessels prior to placement of the vessels downhole, and said signal information indicating the presence of a predetermined downhole condition;

detecting on the surface the signal information on one or more of the vessels;

establishing the presence of the predetermined downhole condition based on the detected signal information.

36. A method according to claim 35 further comprising the step of releasing the vessels at the occurrence of a predetermined event.

37. A method according to claim 36 further comprising the step of sensing the predetermined downhole condition and wherein the vessels are released when the predetermined event is sensed.

38. A method according to claim 37 wherein predetermined event is met when a value sensed reaches a predetermined threshold value, and the predetermined downhole condition is the sensing of the predetermined threshold value at the location where the sensing takes place.

39. A method according to claim 35 wherein the vessels each comprise one or more radio frequency devices that acquire substantially all energy needed for operation by exposure to externally created electromagnetic field.

40. A method according to claim 39 wherein the radio frequency devices are simple dipole antennae.

41. A method according to claim 35 wherein the vessels are at most 2 centimeters in diameter.

42. A method according to claim 35 the step of detecting comprises detecting the signal information as the vessel flows through a tube containing fluid produced form the borehole.

43. A method according to claim 35 wherein each vessel comprises at least one microdot.

44. A method according to claim 35 wherein the predetermined downhole condition is a characteristic of fluid being produced from the borehole.

45. A method according to claim 35 wherein the predetermined condition is a predetermined level of mechanical wear or damage to equipment located downhole.

46. A method according to claim 35 wherein vessels are positioned on a perforation tool and the predetermined downhole condition is the firing of one or more charges on the perforation tool.

* * * * *